US009903134B2

(12) United States Patent
Munnerlyn

(10) Patent No.: US 9,903,134 B2
(45) Date of Patent: Feb. 27, 2018

(54) PORTABLE SHADING ASSEMBLY

(71) Applicant: Ken Munnerlyn, New iberia, LA (US)

(72) Inventor: Ken Munnerlyn, New iberia, LA (US)

( * ) Notice: Subject to any disclaimer, the term of this patent is extended or adjusted under 35 U.S.C. 154(b) by 9 days.

(21) Appl. No.: 15/185,131

(22) Filed: Jun. 17, 2016

(65) Prior Publication Data

US 2017/0362849 A1 Dec. 21, 2017

(51) Int. Cl.

| | |
|---|---|
| ***E04H 15/58*** | (2006.01) |
| ***E04H 15/00*** | (2006.01) |
| ***E04H 15/32*** | (2006.01) |
| ***E04H 15/54*** | (2006.01) |
| ***E04H 15/44*** | (2006.01) |
| ***E04H 15/42*** | (2006.01) |
| ***E04H 15/62*** | (2006.01) |
| ***E04H 15/64*** | (2006.01) |

(52) U.S. Cl.

CPC ..... *E04H 15/005* (2013.01); *E04H 15/322* (2013.01); *E04H 15/42* (2013.01); *E04H 15/44* (2013.01); *E04H 15/54* (2013.01); *E04H 15/58* (2013.01); *E04H 15/62* (2013.01); *E04H 15/64* (2013.01)

(58) Field of Classification Search

CPC ..... E04H 15/54; E04H 15/44; E04H 15/36; E04H 15/322; E04H 15/58; E04H 15/62; E04H 15/64; E04H 15/005

USPC ..... 135/123, 124, 114, 117, 119, 120.4, 902, 135/97

See application file for complete search history.

(56) References Cited

U.S. PATENT DOCUMENTS

| | | | | |
|---|---|---|---|---|
| 1,245,944 | A * | 11/1917 | Morgan | E04H 15/28 135/118 |
| 1,407,040 | A * | 2/1922 | Myers | E04H 15/003 135/118 |
| 1,449,894 | A * | 3/1923 | Dial | E04H 15/28 135/114 |
| 2,660,186 | A * | 11/1953 | Marshall | E04H 15/003 135/153 |
| 3,070,107 | A | 12/1962 | Beatty | |
| 3,371,671 | A * | 3/1968 | Kirkham | E04H 15/06 135/116 |
| 3,404,696 | A * | 10/1968 | de Souza Filho | E04H 15/003 135/115 |
| D306,762 | S | 3/1990 | Aquino | |
| 5,080,123 | A | 1/1992 | Stein | |
| 5,299,590 | A | 4/1994 | Deibert et al. | |

(Continued)

FOREIGN PATENT DOCUMENTS

WO WO2014112859 7/2014

*Primary Examiner* — Winnie Yip

(57) ABSTRACT

A portable shading assembly for provision of shade using a tethered panel includes a mast and a panel. The mast has a bottom configured to couple to a surface. The panel is flexible and has a respective opposing side reversibly couplable to a top of the mast. The mast is positioned substantially equally distant from opposing edges of the panel. A plurality of tethers is coupled to and extends from the panel. Each of a plurality of stakes is reversibly couplable to a respective tether distal from the panel. The panel is positioned to couple to the mast. The mast and the stakes are configured to couple to the surface. The tethers are positioned to couple the panel to the stakes. The panel is positioned above the surface to use the natural force of the wind to inflate the panel and hold it aloft to provide shade to a user.

15 Claims, 5 Drawing Sheets

(56) References Cited

U.S. PATENT DOCUMENTS

| | | | | |
|---|---|---|---|---|
| 5,441,066 | A * | 8/1995 | Harris | E04H 15/28 135/88.01 |
| 5,546,971 | A * | 8/1996 | Leonhardt | E04H 15/003 135/123 |
| 5,853,016 | A * | 12/1998 | Cowan | E04H 15/54 135/115 |
| 5,974,719 | A * | 11/1999 | Simonek | F41A 23/16 211/94.01 |
| 7,789,097 | B1 * | 9/2010 | Sotirkys | E04H 15/06 135/88.01 |
| D638,954 | S | 5/2011 | Nichols | |
| 8,720,461 | B2 * | 5/2014 | Nichols | E04H 15/44 135/117 |
| 9,051,756 | B1 | 6/2015 | Jenkins | |
| 2009/0056781 | A1 * | 3/2009 | Stanley | E04H 15/64 135/122 |
| 2012/0291830 | A1 | 11/2012 | Crimi | |
| 2014/0041703 | A1 | 2/2014 | Funston | |

* cited by examiner

PORTABLE SHADING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shading assemblies and more particularly pertains to a new shading assembly for provision of shade using a tethered panel.

BRIEF SUMMARY OF THE INVENTION

An embodiment of the disclosure meets the needs presented above by generally comprising a mast and a panel. The mast has a bottom configured to couple to a surface. The panel is flexible and has a respective opposing side reversibly couplable to a top of the mast. The mast is positioned substantially equally distant from opposing edges of the panel. A plurality of tethers is coupled to and extends from the panel. Each of a plurality of stakes is reversibly couplable to a respective tether distal from the panel. The panel is positioned to couple to the mast. The mast and the stakes are configured to couple to the surface. The tethers are positioned to couple the panel to the stakes, such that the panel is positioned above the surface to use the natural force of the wind to inflate the panel and hold it aloft to provide shade to a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
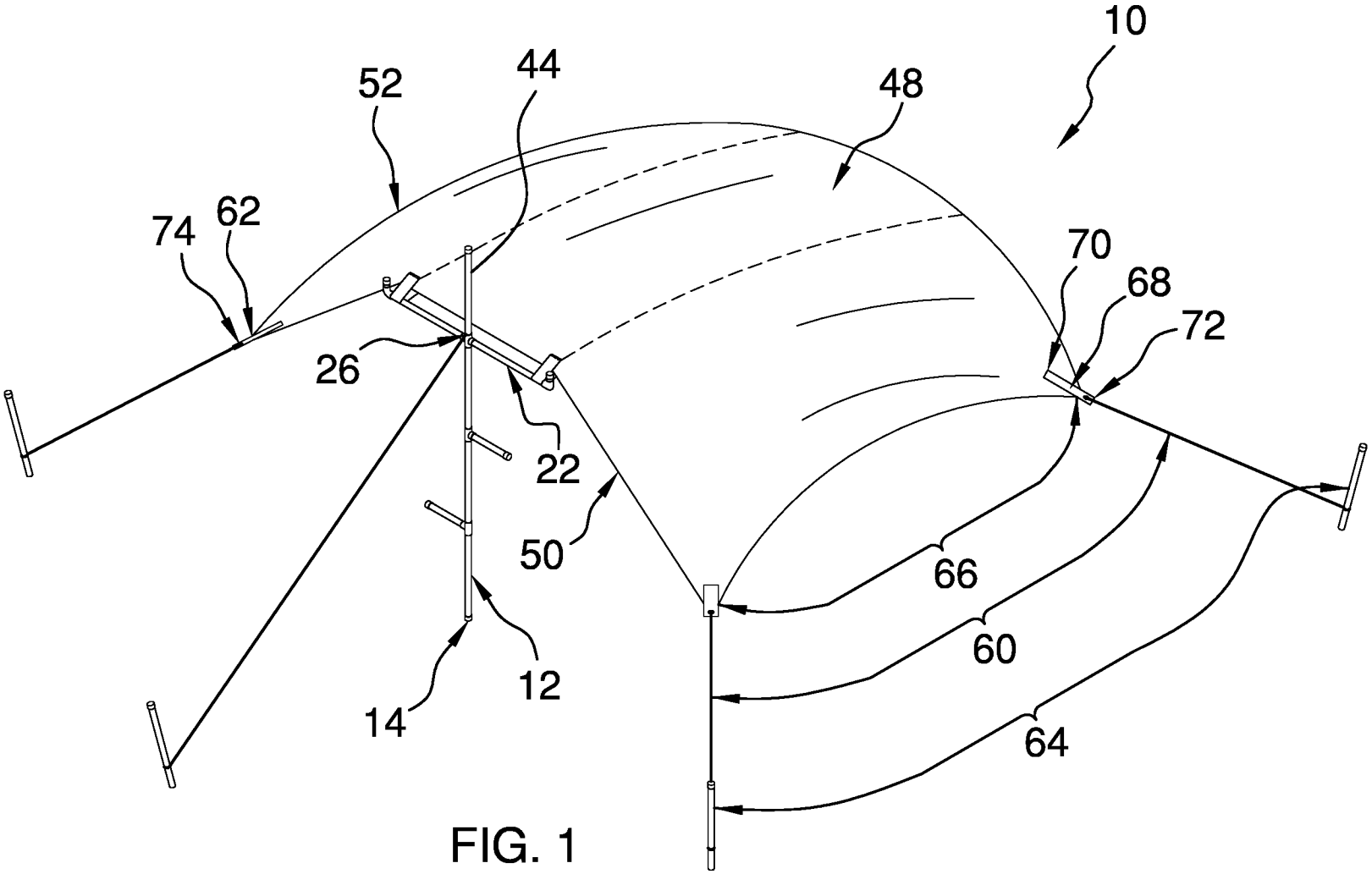
FIG. 1 is an isometric perspective view of a portable shading assembly according to an embodiment of the disclosure.
Figure 2:
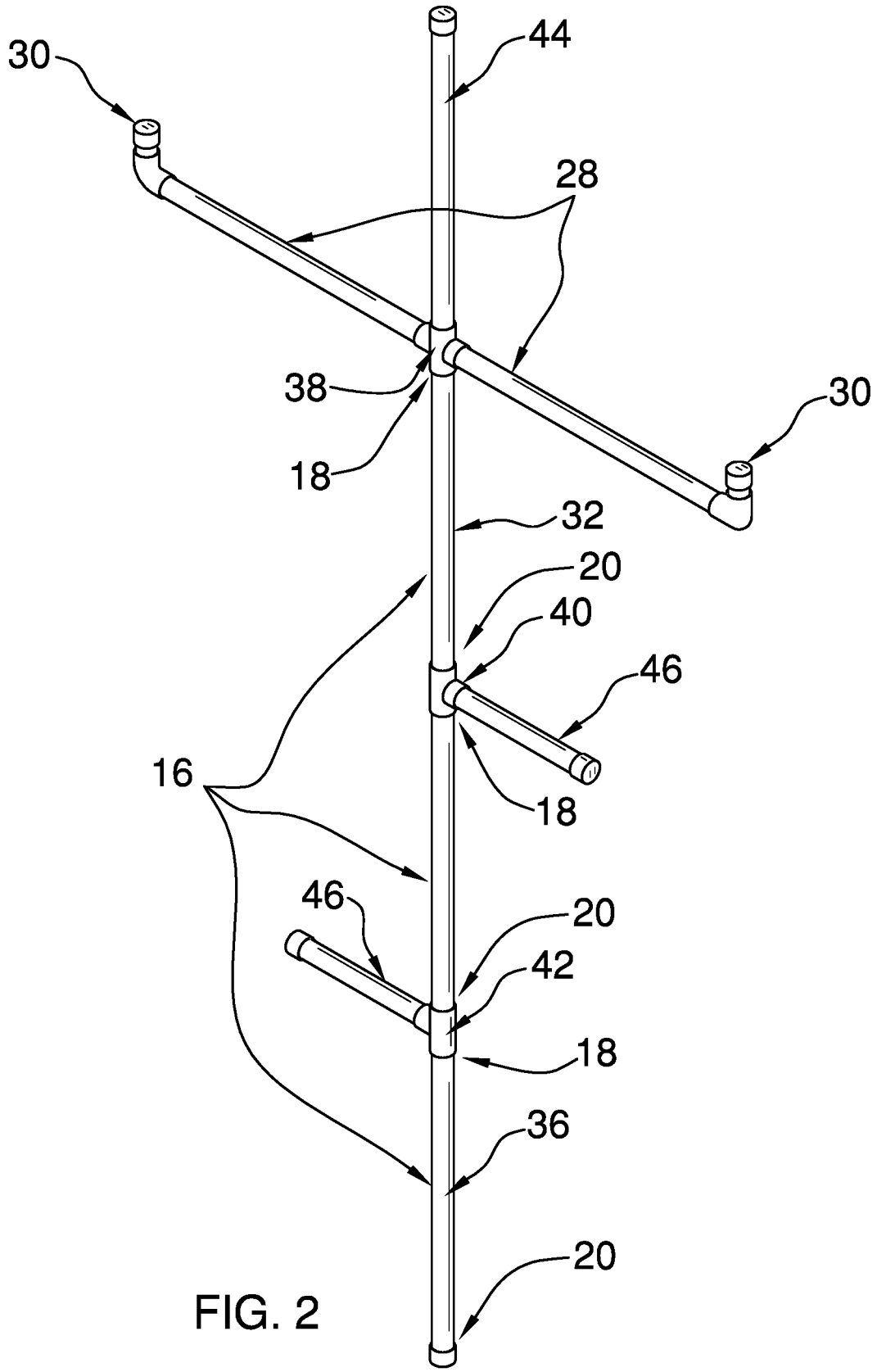
FIG. 2 is an isometric perspective view of an embodiment of the disclosure.
Figure 3:
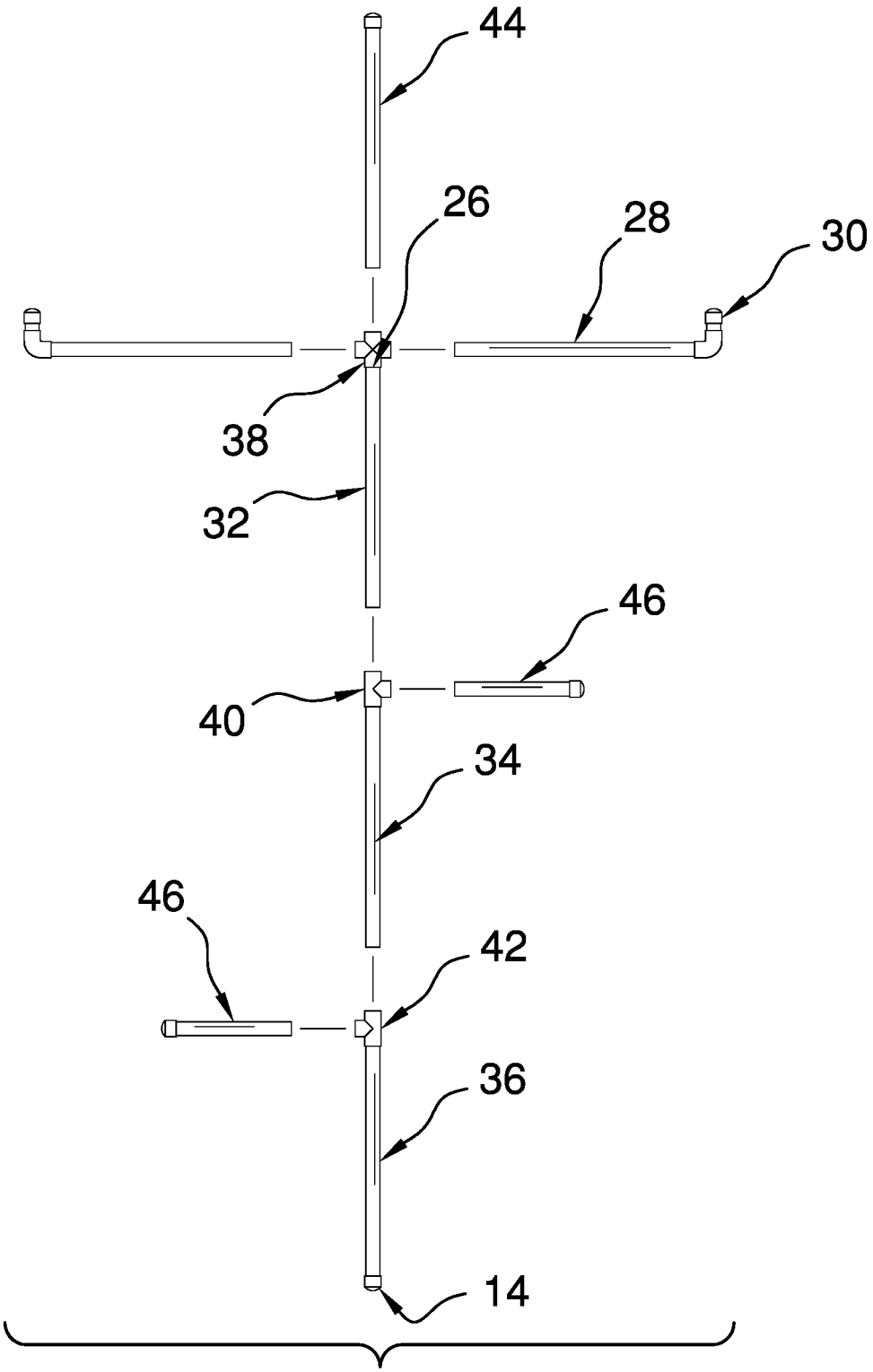
FIG. 3 is an exploded view of an embodiment of the disclosure.
Figure 4:
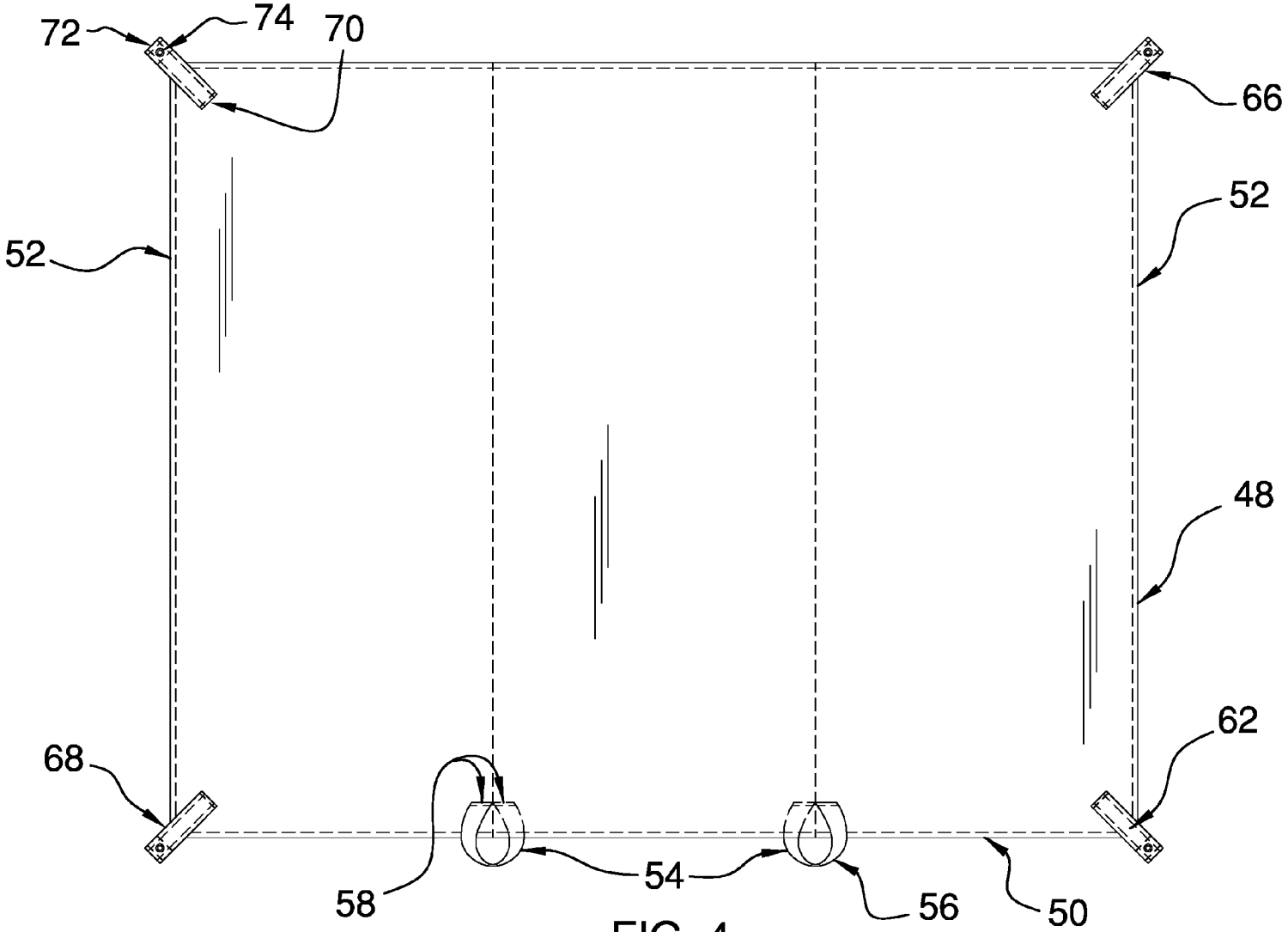
FIG. 4 is a top view of an embodiment of the disclosure.
Figure 5:
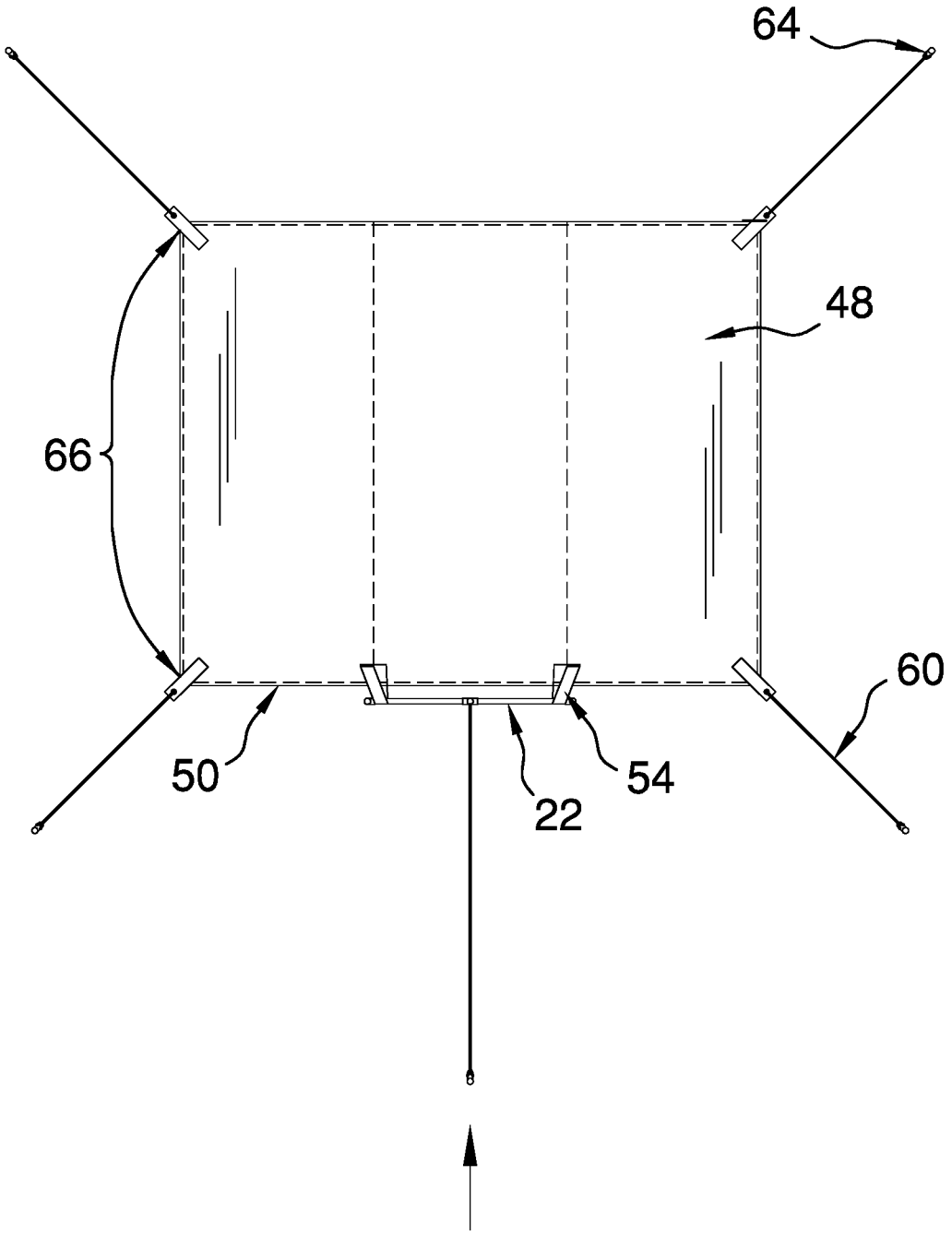
FIG. 5 is an in-use view of an embodiment of the disclosure.

With reference now to the drawings, and in particular to FIGS. 1 through 5 thereof, a new shading assembly embodying the principles and concepts of an embodiment of the disclosure and generally designated by the reference numeral 10 will be described.

As best illustrated in FIGS. 1 through 5, the portable shading assembly 10 generally comprises a mast 12 that has a bottom 14. The bottom 14 is configured to couple to a surface. The mast 12 comprises a plurality of sections 16. Each section 16 has a top end 18 and a bottom end 20. The sections 16 are reversibly couplable such that the mast 12 is collapsible.

A crossbeam 22 is coupled at its midpoint 24 to a top 26 of the mast 12. The crossbeam 22 extends bidirectionally from the mast 12. In one embodiment, the crossbeam 22 comprises a pair of poles 28 that is reversibly couplable to the mast 12. A pair of rods 30 is coupled singly to the crossbeam 22 distal from the midpoint 24. Each rod 30 extends perpendicularly from the crossbeam 22.

In one embodiment, the plurality of sections 16 comprises an upper section 32, a middle section 34 and a lower section 36. The upper section 32 has a cross-connector 38 that is coupled to the top end 18 of the upper section 32. Each pole 28 is reversibly couplable to the cross-connector 38, such that the poles 28 extend perpendicularly from the upper section 32. The middle section 34 has a first T-connector 40 coupled to the top end 18 of the middle section 34. The lower section 36 has a second T-connector 42 coupled to the top end 18 of the lower section 36. The middle section 34 is positioned to reversibly couple to the top end 18 of the lower section 36 and to the bottom end 20 of the upper section 32.

An extension 44 is reversibly couplable to the cross-connector 38 and extends linearly from the mast 12. The extension 44 is positioned on the cross-connector 38 such that the extension 44 is configured to hang a flag.

A plurality of bars 46 is reversibly couplable to and extends perpendicularly from the mast 12. The bars 46 are positioned on the mast 12 such that the bars 46 are configured to hang items on the bars 46. In one embodiment, the plurality of bars 46 comprises bars 46 reversibly couplable to the first T-connector 40 and the second T-connector 42.

The assembly 10 comprises a panel 48 that is flexible. The panel 48 has a side 50 that is couplable to the top 26 of the mast 12. The mast 12 is positioned substantially equally distant from opposing edges 52 of the panel 48. The panel 48 is substantially rectangularly shaped.

A pair of loops 54 is coupled to the respective opposing side 50 of the panel 48. Each loop 54 is positioned on the panel 48 for insertion of a respective rod 30 to couple the crossbeam 22 to the panel 48. Each loop 54 comprises a first strap 56. The first strap 56 has opposing endpoints 58. The first strap 56 is stitchedly coupled to the panel 48 proximate to each opposing endpoint 58, defining the loop 54.

A plurality of tethers 60 is coupled to and extends from the panel 48. The plurality of tethers 60 comprises tethers 60 coupled to each corner 62 of the panel 48 and to the top 26 of the mast 12. In one embodiment, the tethers 60 comprise rope. The tethers 60 comprise braided nylon.

Each of a plurality of stakes 64 is reversibly couplable to a respective tether 60 distal from the panel 48. The plurality of stakes 64 comprises five stakes 64. The stakes 64 comprises plastic.

In one embodiment, a plurality of couplers 66 is coupled to the panel 48. Each coupler 66 is positioned proximate to a respective corner 62 of the panel 48. Each coupler 66 is positioned to couple to a respective tether 60, such that the panel 48 is couplable to the stakes 64. Each coupler 66 comprises a coupling strap 68. The coupling strap 68 has a first end 70 that is coupled to the panel 48 and a second end 72 that extends transversely from the panel 48. The coupling strap 68 comprises a grommet 74 that is positioned through the coupling strap 68 proximate to the second end 72.

The mast 12, the extension 44, the crossbeam 22, the rods 30 and the bars 46 each is tubular. In one embodiment, the mast 12, the extension 44, the crossbeam 22, the rods 30 and the bars 46 each is circular when viewed longitudinally.

The mast 12, the extension 44, the crossbeam 22, the rods 30 and the bars 46 each comprises plastic. In another embodiment, the mast 12, the extension 44, the crossbeam 22, the rods 30 and the bars 46 each comprises polyvinylchloride.

In use, the middle section 34 is positioned to reversibly couple to the top end 18 of the lower section 36 and the bottom end 20 of the upper section 32. The extension 44 is positioned on the cross-connector 38 such that the extension 44 is configured to hang a flag. The bars 46 are positioned on the mast 12 such that the bars 46 are configured to hang items on the bars 46. Each loop 54 is positioned on the panel 48 such that the loop 54 is positioned for insertion of a respective rod 30, wherein the crossbeam 22 is coupled to the panel 48. The mast 12 and the stakes 64 are configured to couple to the surface. The tethers 60 are positioned to couple the panel 48 to the stakes 64, such that the panel 48 is positioned above the surface to use the natural force of the wind to inflate the panel 48 and hold it aloft to provide shade to a user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable shading assembly comprising:

a mast having a bottom, said bottom being configured for coupling to a surface, said mast comprising a plurality of sections, each said section having a top end and a bottom end, wherein said sections are reversibly couplable such that said mast is collapsible, said plurality of sections comprising an upper section having a cross-connector coupled to said top end, a middle section having a first T-connector coupled to said top end, a lower section having a second T-connector coupled to said top end, and wherein said middle section is positioned to reversibly coupled to said top end of said lower section and said bottom end of said upper section;

a crossbeam having a midpoint, said crossbeam being coupled at said midpoint to a top of said mast, such that said crossbeam extends bidirectionally from said mast, said crossbeam comprising a pair of poles reversibly couplable to said mast, each said pole being reversibly couplable to said cross-connector, wherein said poles extend perpendicularly from said upper section;

a pair of rods coupled singly to said crossbeam distal from said midpoint, each said rod extending perpendicularly from said crossbeam;

a panel, said panel being flexible, said panel having a side couplable to said top of said mast, such that said mast is positioned substantially equally distant from opposing edges of said panel;

a plurality of tethers coupled to and extending from said panel;

a plurality of stakes, each said stake being reversibly couplable to a respective said tether distal from said panel;

wherein said panel is positioned to couple to said mast, such that said mast and said stakes are configured to couple to the surface, wherein said tethers are positioned to couple said panel to said stakes, such that said panel is positioned above the surface to use the natural force of the wind to inflate said panel and hold said panel aloft to provide shade to a user.

2. The assembly of claim 1, further including an extension reversibly couplable to said cross-connector and extending linearly from said mast, wherein said extension is positioned on said cross-connector such that said extension is configured for hanging of a flag.

3. The assembly of claim 2, further including a plurality of bars reversibly couplable to and extending perpendicularly from said mast, wherein said bars are positioned on said mast such that said bars are configured for hanging of items on said bars.

4. The assembly of claim 2, further including a plurality of bars, said bars being reversibly couplable to said first T-connector and said second T-connector, wherein said bars are positioned on said mast such that said bars are configured for hanging of items on said bars.

5. The assembly of claim 4, further comprising:

said mast, said extension, said crossbeam, said rods and said bars each being tubular;

said mast, said extension, said crossbeam, said rods and said bars each being circular when viewed longitudinally; and said mast, said extension, said crossbeam, said rods and said bars each comprising plastic.

6. The assembly of claim 1, further including said panel being substantially rectangularly shaped.

7. The assembly of claim 1, further including a pair of loops coupled to said respective opposing side of said panel, wherein each said loop is positioned on said panel such that said loop is positioned for insertion of a respective said rod, such that said crossbeam is coupled to said panel.

8. The assembly of claim 7, further including each said loop comprising a first strap, said first strap having opposing endpoints, said first strap being stitchedly coupled to said panel proximate to each said opposing endpoint defining said loop.

9. The assembly of claim 1, further including said plurality of tethers comprising said tethers coupled to each corner of said panel and to said top of said mast, said tethers comprising rope.

10. The assembly of claim 9, further including said tethers comprising braided nylon.

11. The assembly of claim 9, further including a plurality of couplers coupled to said panel, each said coupler being positioned proximate to a respective said corner of said panel, wherein each said coupler is positioned on said panel such that said coupler is positioned for coupling to a respective said tether, such that said panel is couplable to said stakes.

12. The assembly of claim 11, further including each said coupler comprising a coupling strap, said coupling strap having a first end coupled to said panel and a second end extending transversely from said panel, said coupling strap comprising a grommet positioned through said coupling strap proximate to said second end.

13. The assembly of claim 1, further including said plurality of stakes comprising five said stakes, said stakes comprising plastic.

14. The assembly of claim 1, further including said mast, said extension, said crossbeam, said rods and said bars each comprising polyvinylchloride.

15. A portable shading assembly comprising:

a mast having a bottom, said bottom being configured for coupling to a surface said mast comprising a plurality of sections, each said section having a top end and a bottom end, wherein said sections are couplable such that said mast is collapsible;

a crossbeam having a midpoint, said crossbeam being coupled at said midpoint to a top of said mast, such that said crossbeam extends bidirectionally from said mast, said crossbeam comprising a pair of poles reversibly couplable to said mast;

a pair of rods coupled singly to said crossbeam distal from said midpoint, each said rod extending perpendicularly from said crossbeam;

said plurality of sections comprising:

an upper section having a cross-connector coupled to said top end, each said pole being reversibly couplable to said cross-connector, wherein said poles extend perpendicularly from said upper section, a middle section having a first T-connector coupled to said top end, a lower section having a second T-connector coupled to said top end, and wherein said middle section is positioned to reversibly coupled to said top end of said lower section and said bottom end of said upper section;

an extension reversibly couplable to said cross-connector and extending linearly from said mast, wherein said extension is positioned on said cross-connector such that said extension is configured for hanging of a flag;

a plurality of bars reversibly couplable to and extending perpendicularly from said mast, wherein said bars are positioned on said mast such that said bars are configured for hanging of items on said bars, said plurality of bars comprising said bars reversibly couplable to said first T-connector and said second T-connector;

a panel, said panel being flexible, said panel having a side couplable to said top of said mast, such that said mast is positioned substantially equally distant from opposing edges of said panel, said panel being substantially rectangularly shaped;

a pair of loops coupled to said respective opposing side of said panel, wherein each said loop is positioned on said panel such that said loop is positioned for insertion of a respective said rod, such that said crossbeam is coupled to said panel, each said loop comprising a first strap, said first strap having opposing endpoints, said first strap being stitchedly coupled to said panel proximate to each said opposing endpoint defining said loop;

a plurality of tethers coupled to and extending from said panel, said plurality of tethers comprising said tethers coupled to each corner of said panel and to said top of said mast, said tethers comprising rope, said tethers comprising braided nylon;

a plurality of stakes, each said stake being reversibly couplable to a respective said tether distal from said panel, said plurality of stakes comprising five said stakes, said stakes comprising plastic;

a plurality of couplers coupled to said panel, each said coupler being positioned proximate to a respective said corner of said panel, wherein each said coupler is positioned on said panel such that said coupler is positioned for coupling to a respective said tether, such that said panel is couplable to said stakes, each said coupler comprising a coupling strap, said coupling strap having a first end coupled to said panel and a second end extending transversely from said panel, said coupling strap comprising a grommet positioned through said coupling strap proximate to said second end;

said mast, said extension, said crossbeam, said rods and said bars each being tubular, said mast, said extension, said crossbeam, said rods and said bars each being circular when viewed longitudinally, said mast, said extension, said crossbeam, said rods and said bars each comprising plastic, said mast, said extension, said crossbeam, said rods and said bars each comprising polyvinylchloride;

wherein said middle section is positioned to reversibly coupled to said top end of said lower section and said bottom end of said upper section, wherein said extension is positioned on said cross-connector such that said extension is configured for hanging of a flag, wherein said bars are positioned on said mast such that said bars are configured for hanging of items on said bars, wherein each said loop is positioned on said panel such that said loop is positioned for insertion of a respective said rod, such that said crossbeam is coupled to said panel, such that said mast and said stakes are configured to couple to the surface, wherein said tethers are positioned to couple said panel to said stakes, such that said panel is positioned above the surface to use the natural force of the wind to inflate said panel and hold said panel aloft to provide shade to a user.

* * * * *